United States Patent [19]

Hopta et al.

[11] 4,160,943

[45] Jul. 10, 1979

[54] SWITCHED CURRENT REGULATOR

[75] Inventors: Daniel F. Hopta, Bridgewater, N.J.; Howard R. Beelitz, Gillett, Pa.

[73] Assignee: RCA Corporation, New York, N.Y.

[21] Appl. No.: 906,006

[22] Filed: May 15, 1978

[51] Int. Cl.[2] ..... G05F 3/08; G04C 23/12

[52] U.S. Cl. ..... 323/4; 58/23 BA

[58] Field of Search ..... 58/23 A, 23 BA; 323/1, 323/4, 19

[56] References Cited

U.S. PATENT DOCUMENTS

| | | | |
|---|---|---|---|
| 3,787,757 | 1/1974 | Sheng | 323/4 |
| 3,943,380 | 3/1976 | Morgan et al. | 58/23 BA |
| 4,078,199 | 3/1978 | Chapron et al. | 323/1 |

*Primary Examiner*—A. D. Pellinen

*Attorney, Agent, or Firm*—H. Christoffersen; A. L. Limberg; E. P. Herrmann

[57] ABSTRACT

A current source circuit selectively supplying at least one regulated output current. A reset pulse is provided concurrently with current source inhibit. The current source is adapted to low voltage circuits and dissipates minimal power for all modes of operation.

10 Claims, 2 Drawing Figures

SWITCHED CURRENT REGULATOR

BACKGROUND OF THE INVENTION

This invention relates to current regulator circuits, particularly those implemented in watch or similar systems operating under limited energy sources e.g., batteries, and designed in the bipolar technologies as for example, integrated injection logic ($I^2L$).

In such systems, the limited energy source demands that all circuit functions inherently dissipate minimal power in all operational modes. Electronic watch systems are frequently designed with circuitry that is operated intermittently, such as for setting the time or displaying data etc., or circuitry that is continuously operable except for short periods when some "housekeeping" function is performed at which time the circuitry is inactivated. Circuits of these types fabricated in current controlled logic can be activated or inactivated by a switchable current regulator of the type to be described herein. It is highly desirable that the current regulator dissipate very low power in either the active or inactive state.

The ability to maintain accurate timekeeping is predicated on stable device operation, a part of which is stable current control with varying supply levels. The circuits typically must function over a supply voltage range of 1.0 to 1.6 volts.

Frequently, such watch circuits require a number of independent current sources at separate current levels to energize the several subelements of the watch circuitry. A current regulator capable of such operations is formed around a first transistor and a first collector load means, having substantial direct current impedance, to form a common-emitter or CE amplifier. A second transistor with its base and emitter electrodes respectively connected to the collector and base electrodes of said first transistor provides closed loop feedback around the CE amplifier by means of emitter follower action. The feedback conditions the CE amplifier to regulate the potential between the emitter electrode of the second transistor, which point is also the input to the CE amplifier, and a point of reference potential to which the emitter electrode of the first transistor also returns. This in turn regulates the current that the emitter of the second transistor must supply to a first resistor means connected between the emitter of the second transistor and the point of reference potential to support the regulated potential. The second transistor may be formed with one or more collector electrodes proportioned one to the other to provide output currents related to its emitter current in the same proportions when connected to subsequent circuitry. The collector current of the second transistor may be increased or decreased by quantum steps, as known by the inclusion of forward biased pn junctions in series with the emitter electrode of the first transistor or in series with the first resistive means respectively.

Substantially larger output currents than those supplied from the second transistor may be obtained by applying the regulated potential at the base of the first transistor to bias the base electrodes of one or more transistors having base-emitter junction areas substantially larger than the first transistor, whose emitters are connected to the point of reference potential through current limiting resistive means, and whose collectors are connected to circuits for utilizing said output currents.

Greater insight into the operation of such current regulators may be obtained from U.S. Pat. No. 3,430,155 entitled "Integrated Circuit Biasing Arrangement for Supplying $V_{BE}$ Bias Voltages" issued Feb. 25, 1969 to L. A. Harwood and U.S. Pat. No. 3,320,439 entitled "Low Value Current Source for Integrated Circuits," issued May 16, 1967 to R. J. Widlar. Transistor structures having more than one collector electrode are described in U.S. Pat. No. 3,579,059 entitled "Multiple Collector Lateral Transistor Device" issued May 18, 1971 to R. J. Widlar.

BRIEF SUMMARY OF THE INVENTION

The present invention is embodied in current source circuitry which selectively supplies at least one output current. Each of the regulated currents is generated by a self-biased degenerate transistor amplifier circuit which is normally conducting when power is applied and operates independently of the inhibit means when in this mode. A first transistor is arranged in common-emitter amplifier configuration. Collector-to-base feedback is provided by the base-emitter junction of a second transistor. The feedback establishes a point of constant potential between a point of reference and the emitter of the second transistor. A resistive means interposed between these two points determines the current flowing in the emitter electrode i.e., the current is the potential across the resistive means divided by its resistive value. The emitter current scaled by the common-base current gain is made available at the collector of the second transistor as output current. In accordance with the present invention, the current source is inhibited so it supplies no regulated current using a third transistor having its base electrode connected to a point of critical bias potential, and a switch for selectively connecting its emitter electrode to the point of reference. Closing the switch forward biases the base-emitter junction of the third transistor, conditioning it to supply a reset pulse from its collector circuit, and to clamp the critical bias point to a potential which forces the first and second transistors out of conduction.

DETAILED DESCRIPTION OF THE INVENTION

Figure 1:
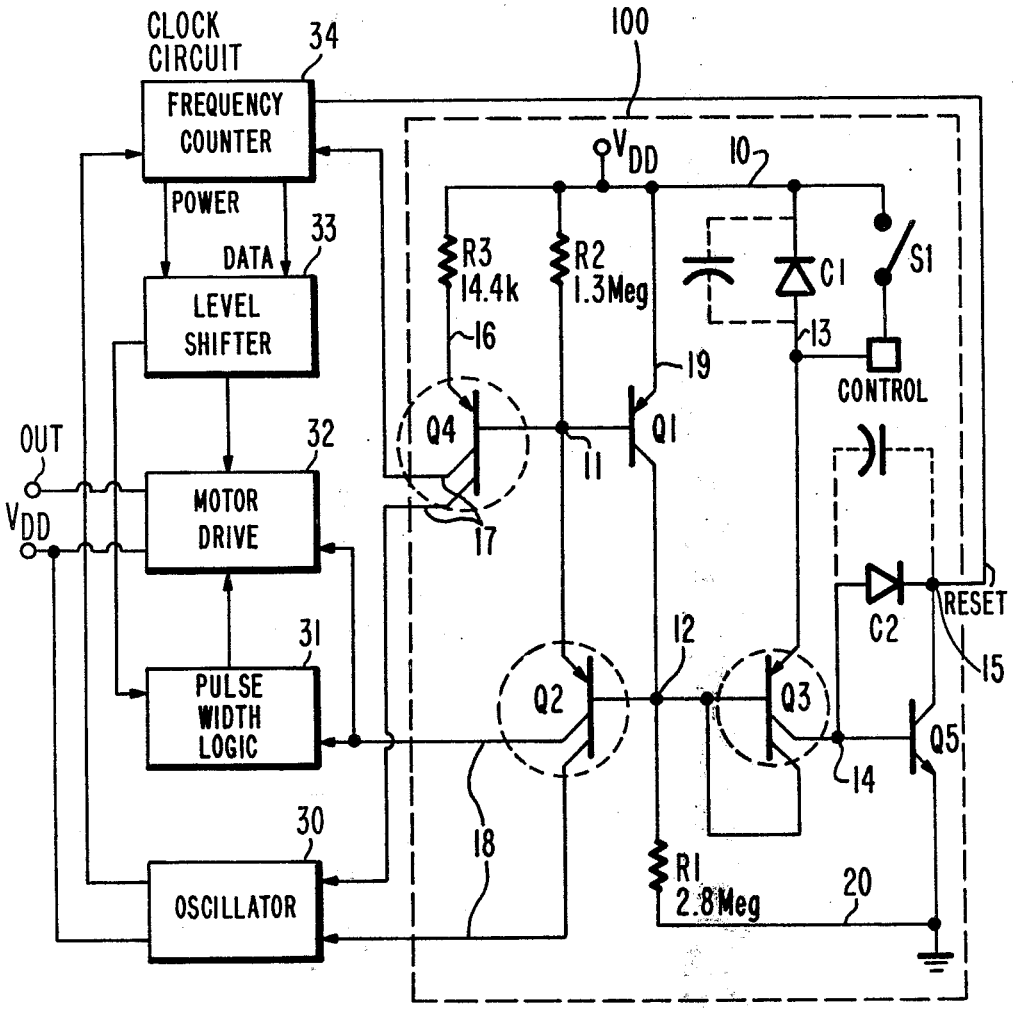
FIG. 1 is a circuit schematic of an embodiment of the invention in which the current source is shown energizing a utilization means comprising the circuitry of an electronically controlled motor driven wall clock.

The circuit of FIG. 1 indicates a particular application in which the invention is useful. The circuit of the invention, shown enclosed by the dashed line, is supplying currents to Current Injection Logic ($I^2L$) used to provide a time-keeping function. The frequency of an electronically generated oscillation is divided down by the $I^2L$ circuitry to provide electrical impulses at the rate of one per second to activate a motor drive means for moving the hands of a clock in discrete increments.

Primary power to a crystal-controlled oscillator circuit 30 is supplied by the $V_{DD}$ bus 10. The conversion of this power to oscillations of a fixed frequency is controlled by the bias currents derived from the first set of collectors 17 and 18 of transistors Q4 and Q2, respectively. The frequency generated by 30 is applied to a frequency counter 34. This frequency counter 34 in a particular construction embodying the present invention is a system of $I^2L$ binary counters. Responsive to the application of a control current from a second collector of Q4, the counter 34 divides the oscillator frequency into signal units corresponding to hours, minutes, and seconds. Each of the counter elements has two stable states. Switching between states responsive to an electrical stimulus performs the division. These counter elements however, can start in either of their two states when power is applied to the circuit. During a reset interval, a reset pulse is provided from the collector of transistor Q5 for initially placing the binary elements in the proper starting state, during which interval the application of collector currents from Q2 and Q4 to oscillator 30, a logic circuit 31, and counter 34 is interrupted. The signals generated by the frequency counter 34 are applied to a level shifter circuit 33 that converts output signals from the counter 34 to appropriate levels for application to a motor drive circuit 32 and a logic circuit 31 used to control the width of the pulses the motor drive circuit 32 supplies to a clock motor (not shown). $I^2L$ circuits operate at low voltage levels. If counter 34 is realized as an $I^2L$ circuit with a 1.5 volt power source, two levels of logic may be implemented operating in series with the supply. Typical output voltage amplitudes for such an arrangement would operate with logic swings of 0.00 volt and 0.55 volt for a logic "zero" and a logic "one" respectively at the lower level and 0.55–1.10 volts for the higher level. Level shifter 33 in such case would be used to convert a 0.55–1.10 logic swing derived from 34 to a 0.00–0.55 logic swing for application to circuits 31. Pulse width logic 31 responds to collector current from Q2, supplied except during a reset time, to condition the output signal to minimize power consumed by the ultimate display mechanism.

$I^2L$ circuits are conventionally powered from current sources in order to obtain accurate control of the power dissipated and maintain the desirable feature of a low speed-power product. It is generally advantageous to isolate the supply sources to subsections of a large integrated array for the purpose of minimizing the possibility of transient conditions (i.e., large current drains) which occur in one subsection, from affecting another subsection. Implementation of isolated supply sources from a single external energy source can be realized with the present invention. Certain systems have the added requirement that the circuit driven by the current source be capable of shutdown to save energy, e.g. consider a clock which is supplied at manufacture with an installed battery, in which battery drain must be held at a minimum until it is in the possession of the consumer. Additionally, some systems require a reset pulse to place the logic in the proper state when the shutdown control is released.

Transistors Q1 and Q2, collector load means R1 and resistive means R2 form a basic voltage regulator wherein a constant voltage is maintained between terminals 10 and 11 as taught by Harwood. Resistive means R2, connected between points of constant potential 10 and 11 supports a constant current and essentially establishes the emitter current of Q2, the base currents of transistors Q1 and Q4 contributing negligible current to the emitter electrode. This current scaled by the common base current gain of Q2 is accessible at the collectors of Q2 as output currents. The regulated potential between terminals 10 and 11 is applied to forward-bias the base-emitter circuit of transistor Q4, establishing a second current source means of he sort described by Widlar, and the base-emitter circuit of Q1, the base currents of Q1 and Q4 flowing as portions of the emitter current of Q2. The base-emitter circuit of Q2 is forward-biased by a portion of the current supplied to terminal 12. Terminal 12 must be maintained at a potential at least two forward-biased, base-emitter junction potential or $V_{BE}$ drops more negative than the potential at the emitter electrode 19 of transistor Q1 in order to bias Q2 into conduction. The self-biasing capability of the regulator circuit maintains the potential at 12 at this $V_{DD}$-$2V_{BE}$ level so long as external perturbations are not applied to terminal 12.

The invention concerns the means for inhibiting the regulator circuitry thus far described, so it does not supply regulated output currents, and concurrently supplying a reset pulse. Referring to FIG. 1, transistor Q3 and switch means S1 perform the inhibit and reset functions.

Switch S1, when closed, provides a direct current conductive path between the emitter electrode of Q3 and supply terminal 10, applying the potential of 10 directly to the emitter. This forward-biases the base-emitter junction Q3, causing terminal 12 to be clamped at one $V_{BE}$ more positive than the potential which is necessary between terminals 12 and 19 to maintain Q2 in conduction. With Q2 out of conduction, Q4 is denied base bias current and is turned off. So the collector currents of Q2 and Q4, or the regulator output currents are thereby discontinued and the regulator operates in an inhibited or inactive state.

Transistor Q3 is preferably constructed with two collector electrodes, the first of which is direct-coupled to the base electrode of said transistor to reduce the current that would otherwise flow in the base-emitter junction. This configures Q3 as a current mirror in which the current in the first collector electrode is mirrored into the second collector electrode in proportion to the ratio of the base-collector areas of the first and second collectors.

Transistor Q3 is biased into conduction by the closure of S1. The combination of the base current and the first collector current of Q3 directed into 12 support the potential across R1 at one $V_{BE}$ below the supply potential. The total current flowing in the first and second collectors is equal to the base current of Q3 times its beta, or common-emitter current gain. The total collector current of Q3 is divided between its first and second collectors by design in a ratio selected depending upon how the current of the second collector will be used.

Ultimately, this second collector current effects the reset means but the mode in which it is applied may vary. For example, in the circuit of FIG. 1, the current from the second electrode provides the base drive of Q5, which current is relatively small. So the division of current between the first and second collectors would reflect this requirement—i.e., said first collector would be designed to receive the majority of current. Alternatively, were the current of the second collector to be used for driving the emitter of a common-base biased transistor, a larger second collector current could be required from Q3 in which case the division of current in Q3 would be designed to accommodate this current.

Figure 2:
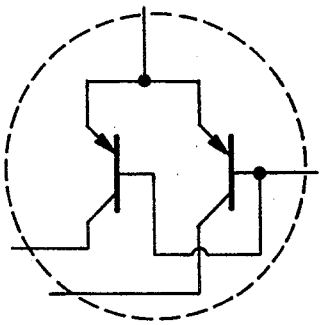
FIG. 2 is a circuit schematic of an alternate means for realizing the collector structure of transistors $Q_1$, $Q_3$ and $Q_4$ with a system of parallel transistors.

Transistor Q3 may alternatively be realized with paralleled transistors as indicated in FIG. 2. The dual transistor or multiple collector implementations result in lower power dissipation by a factor of beta as compared to using a single collector transistor.

Switch S1 presents a relatively low impedance path when closed, and a relatively high impedance path when open. Switch S1 may be an electronic switching means and assembled or integrated with the regulator, or it may be a mechanical or electromechanical means separate from the circuit, as required.

Closure of S1 conditions the regulator circuit to pass current primarily through the emitter electrode of Q3. In the circuit of FIG. 1, the majority of this current is caused to flow in said first collector and subsequently through R1. Under these conditions, the approximate power dissipated by the circuit is $$V_{DD}(V_{DD}-V_{BE})/R1 \quad (1)$$

where R1 is the resistive value of R1 and $V_{DD}$ is the supply potential applied between terminals 10 and 20. Given a $V_{DD}$ of 1.5 volts and the R1 value in the figure, the power dissipated is less than 0.5 microwatt which is extremely low. R1 may be replaced by a constant current generating circuit.

Collector current from Q3 driving the base of Q5 provides the reset capability. Transistor Q5 responds to the first collector current of Q3 providing a relatively low or high conductance path between terminals 15 and 20 whenever S1 is open or closed respectively. Reset occurs when Q5 operates in the high conductance state and passes current between its collector and emitter electrodes.

Automatic reset, when power is applied between terminals 10 and 20, is obtainable by adding capacitive means C1 in parallel connection with S1. C1 may be provided, for example, by a reverse-biased pn junction. Assuming that S1 is open and that no energy source is connected across terminals 10 and 20, C1 will be discharged due to various leakage paths. Application of a potential between terminals 10 and 20 will induce a potential at the emitter electrode of Q3, by the electrostatic induction of C1, in such direction as to forward-bias the emitter-base junction of Q3. This causes Q3 to supply a collector current to effect reset and disables the regulator. The collector current of Q3 will flow and be proportional to the charging current of C1 until the potential across C1 is equal to $V_{DD}-V_{BE}$. Once C1 is charged, currents cease flowing to Q3; and the regulator reverts to its normal or conducting mode.

A second capacitive means C2, connected between the base electrode 14 and the collector electrode of Q5 will extend the reset period beyond the time when the regulator has returned to normal operation. This may be desired to insure steady-state operation of the regulator before the reset is released. During the reset period Q5 operates in saturation, clamping its collector at its saturation voltage, which is one or two tenths of a volt above the potential at 20. Terminal 14 is at one $V_{BE}$ above this potential (approximately 0.6 volt above, for silicon transistor circuitry.) Under these conditions, C2 charges to approximately 0.4 volt with the base-capacitor interconnection of Q5 relatively positive with respect to the collector-capacitor interconnection. Opening S1 interrupts the current flowing from the collector Q3 that provides base bias current for Q5. When this occurs, C2 begins to discharge through the base-emitter junction of Q5 and sustains Q5 in conduction for a limited, time after S1 has been opened. The charge available on C2 to sustain conduction in Q5 is partially multiplied by the Miller effect i.e., as Q5 tends to turn off the potential at the collector electrode of Q5 begins to move positive. This increase in potential is coupled through C2 to the base of Q5 as an apparent increase in charge to reinforce its base drive. The required extension of this period is determinative of the size or value of C2.

Analogous circuitry to that described above may be realized with complementary enhancement mode MOS devices, by replacing the bipolar transistors with their MOS counterparts. Collector, base and emitter electrode connections correspond to drain, gate and source electrode connections respectively in these embodiments of the invention; and the following claims should be construed to include such embodiments within their scope. One additional conductive means would be required in the MOS circuit to prevent charge storage at the control electrode of the MOS analogue of Q5. In addition, the threshold voltages of the MOS transistors would be determinative of the minimum energizing supply.

The circuit shown in FIG. 1 is shown driving a clock circuit as a utilization means, but it is not to be implied that the current source is in any way restricted to this application. It will be understood that various omissions and substitutions and changes in the form and details of the device illustrated may be made by those skilled in the art without departing from the spirit of the invention; and the following claims should be accordingly construed.

What I claim is:

1. In combination with a current regulator of the type including first and second terminals for applying an energizing source therebetween; first and second transistors of a first conductivity type having base and emitter and collector electrodes; means connecting the base and emitter electrodes of said second transistor to the collector and base electrodes of said first transistor respectively; means connecting the emitter electrode of said first transistor to said first terminal; first collector load means having substantial direct current impedance connected between the collector electrode of said first transistor and said second terminal; means connected to the collector electrode of said second transistor for conditioning said transistor to conduct current between its collector and emitter electrodes, the foregoing connections forming means tending to regulate the potential between the emitter electrode of said second transistor and said first terminal; and means connected between said first terminal and the emitter electrode of said second transistor for determining the amplitude of the output current from said regulator; means for disabling the operation of said current regulator and providing a concurrent reset pulse which means comprises:

a third transistor of said first conductivity type having base and emitter and collector electrodes, with said base electrode connected to the base electrode of said second transistor;

a third terminal for supplying reset pulses to which a first collector of said third transistor is connected; and switching means having relatively low impedance when closed and relatively high impedance when open for selectively connecting the emitter electrode of said third transistor to said first terminal, said switching means when closed conditioning the emitter-base junction of said third transistor for clamping the potential between said first terminal and the base electrode of said second transistor at a potential insufficiently large to support current flow between the emitter and collector electrodes of said second transistor.

2. A current regulator as defined in claim 1 including a fourth transistor of a second conductivity type complementary to said first conductivity type, having a base electrode connected to a first collector electrode of said third transistor, and having emitter and collector electrodes respectively connected to said second terminal and to a fourth terminal for effecting reset.

3. A current regulator as defined in claim 2 including first capacitive means connected between the collector and base electrodes of said fourth transistor.

4. A current regulator as defined in any one of claims 1, 2 or 3 wherein said third transistor has a second collector electrode direct coupled to its base electrode for conditioning it to operate as a current mirror.

5. A current regulator as defined in claim 4 including a second capacitive means connected between the emitter electrode of said third transistor and said first terminal.

6. A current regulator as defined in any one of claims 1, 2 or 3 including a second capacitive means connected between the emitter electrode of said third transistor and said first terminal.

7. A current regulator as defined in any one of claims 1, 2 or 3 including: a further transistor of said first conductivity type, having a base electrode to which the emitter electrode of said second transistor is direct coupled, having an emitter electrode connected to said first terminal, and having a collector electrode connected to a further terminal at which output current is available.

8. A current regulator as defined in claim 7 wherein said third transistor has a second collector electrode direct coupled to its base electrode for conditioning it to operate as a current mirror.

9. A current regulator as defined in claim 8 including a second capacitive means connected between the emitter electrode of said third transistor and said first terminal.

10. A current regulator as defined in claim 1 wherein the first collector load means essentially consists of a first resistor connecting said second terminal and the collector electrode of said first transistor and wherein said means connected between said first terminal and the emitter electrode of said second transistor, essentially consists of a second resistor connecting said first terminal and the emitter electrode of said second transistor.

* * * * *